United States Patent [19]

Bromley

[11] 4,236,043

[45] Nov. 25, 1980

[54] FREQUENCY COMPRESSION AND EXPANSION USING AN ELECTROOPTICAL PROCESSOR

[75] Inventor: Keith Bromley, San Diego, Calif.

[73] Assignee: The United States of America as represented by the Secretary of the Navy, Washington, D.C.

[21] Appl. No.: 29,796

[22] Filed: Apr. 13, 1979

[51] Int. Cl.[3] ..... G06G 7/19; G10L 1/00

[52] U.S. Cl. ..... 179/1.5 H; 179/1 SA

[58] Field of Search ..... 179/15.55 T, 15.55 R, 179/1.5 H; 364/754, 822, 837

[56] References Cited

U.S. PATENT DOCUMENTS

| | | | |
|---|---|---|---|
| 3,937,942 | 2/1976 | Bromley et al. | 364/822 |
| 4,009,380 | 2/1977 | Bocker et al. | 364/837 |
| 4,165,541 | 8/1979 | Varshney et al. | 357/24 |

OTHER PUBLICATIONS

Unsigned, "Unscrambler Improves Communications in Helium-Oxygen Atmospheres", Westinghouse Engineer, Jan. 1969, pp. 30–31.

*Primary Examiner*—Felix D. Gruber
*Assistant Examiner*—E. S. Kemeny
*Attorney, Agent, or Firm*—Richard S. Sciascia; Ervin F. Johnston; Thomas Glenn Keough

[57] ABSTRACT

A method of compressing or expanding the frequency of signals while keeping the signals' original gross temporal relationship relies upon an electrooptical processor. An apertured mask is interposed between an area-array charge coupled device (CCD) and a light emitting diode (LED). Optical signals are emitted from the LED at a clock rate which is the same as the vertical shift rate of charge packets in the CCD. Sampling the CCD's horizontal shift register output at varying rates allows a changing of the frequencies of the optical signals or a reoccurring reversal of sequential portions. Weighting the apertured mask to define at least one Gaussian curve or triangular waveform smooths and eliminates breaks in the compressed or expanded frequencies. Sampling the CCD output at a slower rate than the vertical clock rate compresses the frequency of the representative optical signals and if the CCD output is sampled at a faster rate then the signals will be expanded or rearranged in a sequentially reoccurring order. Thus, the electrooptic processor accomplishes a compression or expansion of signals with the signal's original gross temporal relationship and does not rely upon any mechanically displaceable parts. An optional approach employs a line-array CCD detector and a bidirectionally movable apertured mask to accomplish substantially the same end results; however, this introduces the problems usually associated with mechanical devices.

18 Claims, 22 Drawing Figures

FIG. 1.
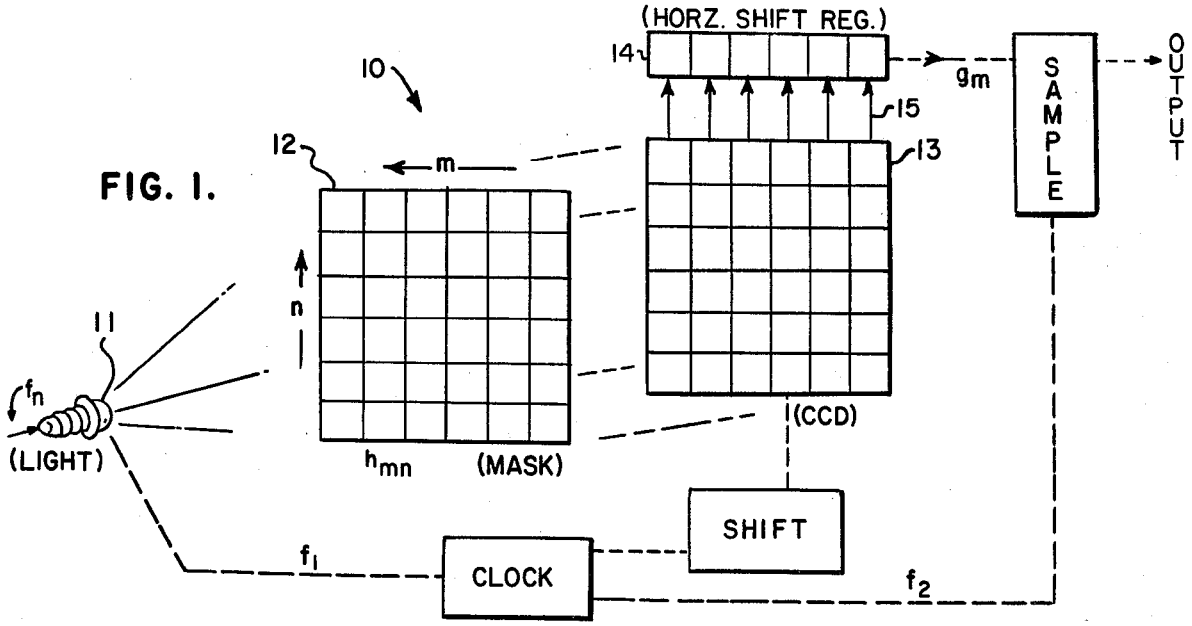
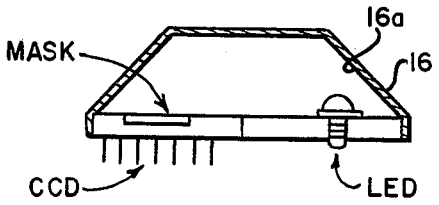
FIG. 2.
PRIOR ART
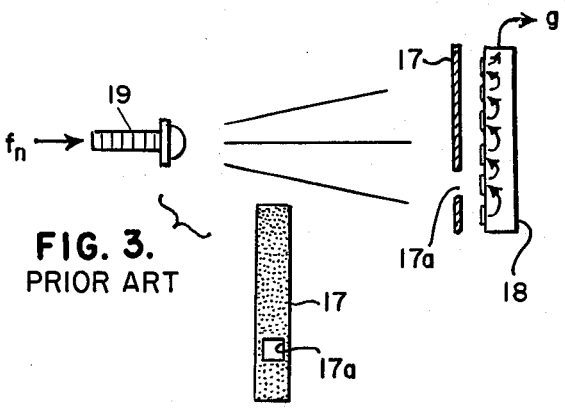
FIG. 3.
PRIOR ART
FIG. 4.
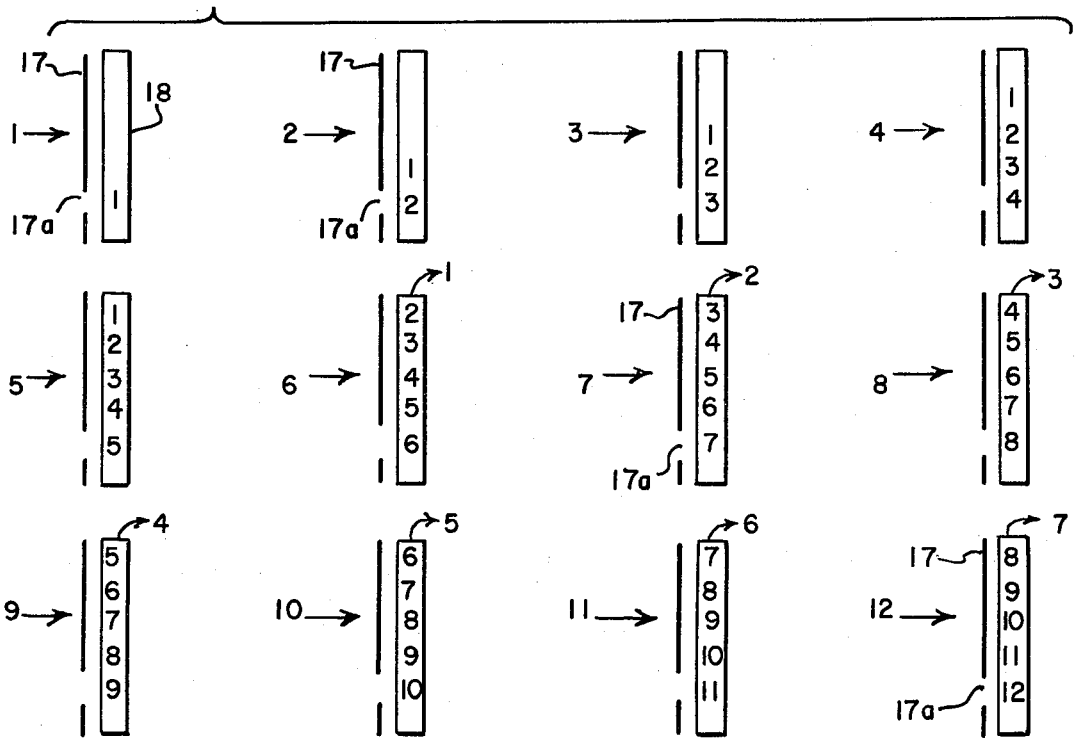

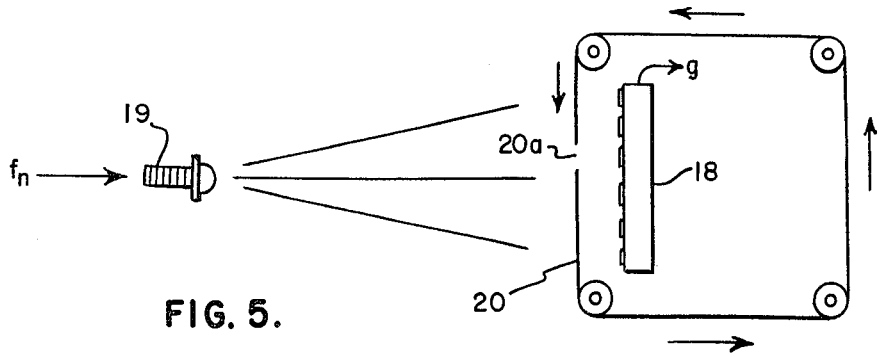
FIG. 5.
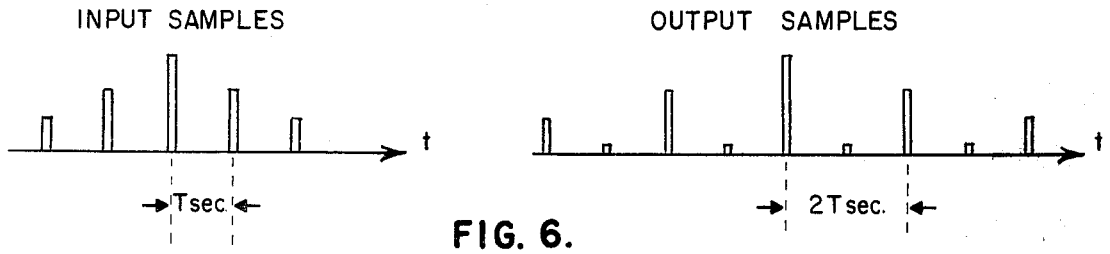
FIG. 6.
FIG. 7.
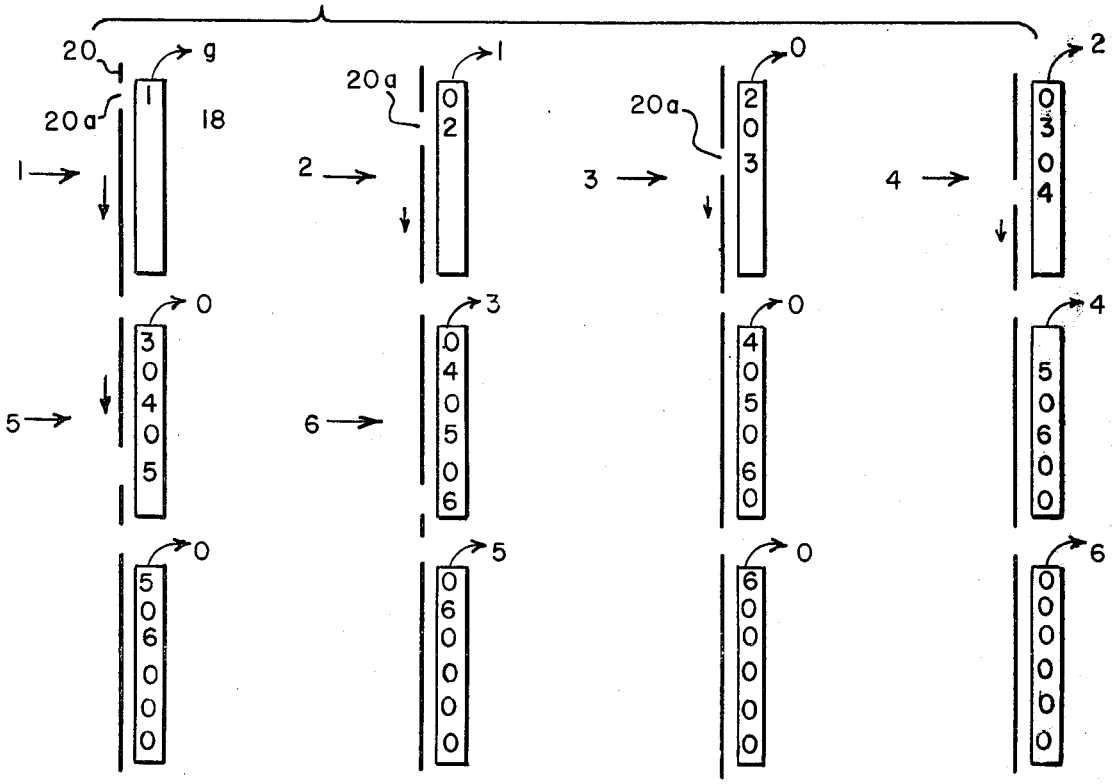

23
23a
23a

INPUT TO LED
OUTPUT FROM CCD
EVER 6th SAMPLE (STARTING AT #3 CCD SHIFT FOR EXAMPLE)
EVERY 7th SAMPLE (STARTING AT #3 FOR EXAMPLE)
EVERY 4th SAMPLE (STARTING WITH #6 FOR EXAMPLE).

INPUT TO LED 7 8 9 10 11 12 13 14

OUTPUT OF CCD IS THE POINT-BY-POINT SUM OF THESE TWO ROWS:—

1 2 3 4 5 6 | 2 3 4 5 6 7 | 3 4 5 6 7 8 | 4 5 6 7 8 9 | 5 6 7 8 9 10 | 6 7 8 9 10 11 | 7 8 9 10 11 12 | 8 9 10 11 12 13 | 9 10

3 4 5 1 2 3 | 4 5 6 2 3 4 | 5 6 7 3 4 5 | 6 7 8 4 5 6 | 7 8 9 5 6 7 | 8 9 10 6 7 8 | 9 10 6 7 8 9 | 10 11 12 8 9 10 | 11 12

EVERY 7th SAMPLE OF THIS OUTPUT YIELDS:

1 3 5 7 9 11 8 10 12 14 16 18 15 17 19 21 23 25

3 5 7 4 6 8 10 12 14 11 13 15 17 19 21 18 20 22

THIS CAN BE THOUGHT OF AS THE SUM OF A SEQUENCE OF GAUSSIAN-WEIGHTED SEGMENTS:

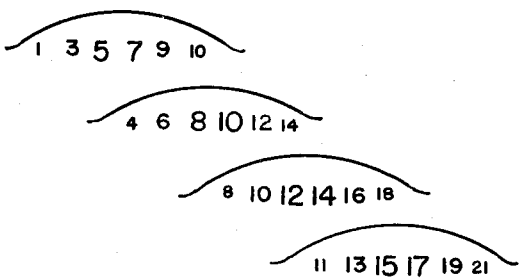

THE SUM WILL HAVE A NEARLY CONSTANT WEIGHTING:

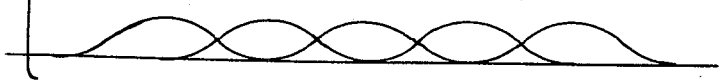

FIG. 19.

EVERY 8th SAMPLE OF THE CCD OUTPUT: (STARTING AT SAMPLE #1)

1 4 7 7 8 11 9

3 6 4 7 10 8 11

EVERY 6th SAMPLE OF THE CCD OUTPUT: (STARTING AT SAMPLE #1)

1 2 3 4 5 6 7 8 9

3 4 5 6 7 8 9 10 11

EVERY 5.5th SAMPLE OF THE CCD OUTPUT (STARTING AT SAMPLE #6).

6 6 7 7 8 8 9 9 10

3 3 4 4 5 10 11 11 12

EVERY 5th SAMPLE OF THE CCD OUTPUT (STARTING AT SAMPLE #6).

6 6 6 6 6 6 11 11 11 11 11 11

3 3 3 8 8 8 8 8 8 13 13 13

EVERY 4th SAMPLE OF THE CCD OUTPUT (STARTING AT SAMPLE #6).

6 5 4 8 7 6 10 9 8 12 11 10

3 2 6 5 4 8 7 6 10 9 8 12

FIG. 20.

FREQUENCY COMPRESSION AND EXPANSION USING AN ELECTROOPTICAL PROCESSOR

BACKGROUND OF THE INVENTION

Signal processing systems relying on a light emitting diode (LED), a photographic masks and an area-array charge coupled device (CCD) have been used to perform linear operations generically characterized by the equation $$g_m = \sum_{n=1}^{N} h_{mn} f_n, \; m = 0, 1, 2, \text{---}, M.$$

where: $g_m$ represents the output values from the CCD horizontal shift register, $h_{mn}$ represents optical transmittance values of an M by N element array mask and $f_n$ represents an analog sampled-data input sequence. A typical system is disclosed in U.S. Pat. No. 3,937,942 issued to Keith Bromley et al., and entitled "Multi-Channel Optical Correlation System." An aligned mask and CCD are illuminated by an LED and electrooptically cooperate for cumulatively shifting charges in the CCD to generate a sequence of cumulative charge outputs indicative of the degree of correlation between the signal which drives the LED and the signals recorded on each column of the matrix mask. Thusly, identification of an input signal can be made by its simultaneous comparison with a large plurality of known stored reference signals. The electrooptical processor was used solely for the purpose of pattern recognition, that is, the comparing and correlating an unknown function or signal to a number of known functions so that the identity of the unknown function could be determined.

Another electrooptical processing technique is disclosed in U.S. Pat. No. 4,009,380 and is entitled "Electro-Optical System for Performing Matrix-Vector Multiplication". This patent was issued to Richard P. Bocker et al., and had a modulated LED transmitting light through a mask and onto a photo-responsive integrating detector, such as an area-array CCD. As in the previous patent, the shift rate of the charge packets within the CCD is synchronized with the modulation of the LED and develops cumulative signals in the CCD which correspond to the product of the input sequence times the signal information contained in each element of the mask to achieve a matrix-vector multiplication. This system is an adaptation of optical techniques to facilitate the making of predetermined mathematical values, called linear transformations, which hitherto were produced by laborious mathematical procedures carried out by a series of lengthy, complex, and detailed individual mathematical computations. Additional capabilities of the patented system appeared in the July 1974 issue of Applied Optics 7, on pages 1670 et seq., in an article entitled "Matrix Multiplication Using Incoherent Optical Techniques" by Richard P. Bocker. The encoding of a matrix of analog information on a two-dimensional binary optical transparency is discussed as well as the proven feasibility of demonstrating a one-dimensional discrete finite Fourier transform.

A further disclosure regarding a combined LED, photographic mask, and area-array CCD is investigated and elaborated on at length by Michael A. Monahan et al., in the article entitled "The Use of Charge Coupled Devices in Electro-Optical Processing" appearing in the Proceedings of the 1975 International Conference on the Application of CCDs, page 217. This article concerns itself with line-array CCDs and area-array CCDs arranged in much the same manner as the two aforesighted patents to effect matrix multiplications and transformations.

Further research in the electrooptical signal processing field is disclosed in the article "Incoherent Optical Signal Processing Using Charge Coupled Devices (CCDs)" as it appears in SPIE Vol. 118, Optical Signal and Image Processing (IOCC 1977). The capabilities of the combination of an LED, photographic mask, and a CCD are shown to be increased such that a processor can perform a variety of linear transformations, multichannel cross-correlations, filtering, and high-density read-only memory applications. Nonlinear and recursive filtering capabilities are also within the capabilities of this arrangement when real-time programmable masks are incorporated.

Three recent articles, coauthored by the present inventor, concern themselves with developments in the electrooptical signal processing field. A paper, "An Electrooptical Processor", by Michael A. Monahan et al., invited for the Proceedings of the Technical Program, Electro-Optics/Laser '78 Conference and Exposition, Boston Massachusetts, pp 479–487 on 19-21 September '78, discusses the design of optical cavities to provide uniform illumination of the CCD by the LED. Another paper by Anthony C. H. Louie et al., called "The EOP-A CCD-Based Electro-Optical Processor" appeared in Proceedings of the 1978 International Conference on the Application of Charge Coupled Devices, San Diego, California pp 3A32-3A41, 25–27 October 1978. Circuit diagrams were disclosed which showed LED-driving and CCD-clocking circuitry. A later publication by Keith Bromley et al., entitled "An Electro-Optical Signal Processing Module" appeared in the Digest of Papers, 1978 Government Microcircuit Applications Conference, Monterey, California pp 336–340, 14–16 November '78. This publication discloses a modified CCD architecture to allow increased speed and flexibility in electrooptical signal processing applications.

Thus, from the foregoing, it is apparent that electrooptical processors have evolved into a highly useful family of instrumentations for performing a variety of complex mathematical functions. However, to date, these functions have not included the compressing and expanding of audio signals within their original temporal relationship so that speech, for example, can remain unscrambled and intelligible.

One method of frequency compression and expansion is disclosed in a paper "Theory of Communication, Part 3: Frequency and Expansion" by D. Gabor in the J. I. E. E. (London) vol. 93 (LLL), pp 429–457 November 1946. The theory and mechanical devices allowed for a somewhat acceptable frequency conversion; however, the mechanical apparatus was rather complicated, bulky and of questionable long term reliability.

The article "The Digital Delay Line Revisited" by Richard Factor as it appeared on page 30 of the May 1976 issue of dB Magazine bespoke of pitch changing using random access memories (RAM). The electronic system that accomplishes frequency shifting is complicated and the use of RAM along with A/D and D/A converters necessitates complex switching sequences.

SUMMARY OF THE INVENTION

The present invention is directed to providing a method of compressing or expanding the frequency of signals and keeping the signals' original gross temporal relationships by an electrooptical processor. First, there is the projecting of temporally modulated optical signals through an apertured mask at which place there is a spatial modulating of the magnitude of the projected optical signals. Optionally, the apertured mask is fixed or bidirectionally moveable to ultimately contribute to a compressing or expanding of the signals. A transforming of the modulated projected signals into a number of charge packets is effected by an area-array CCD. These charge packs undergo a shifting vertically. As the charge packets shift, there is a cumulative summation of charge within these packets due to time varying illumination. At the top of each CCD column, the resulting charge packets is the product of the incoming time waveform and that column's mask function. In a typical CCD, these charge packets are sensed and read out through a parallel-to-serial converter as an output voltage sequence. Next, a sampling of this CCD output at a rate different than the CCD vertical clock rate effects an optional compressing or expanding of the frequency of the signals within the signals' original gross temporal relationship.

It is a primary object of the invention to provide a method by which signals representative of audio information are compressed or expanded within their own temporal relationship.

Another object is to provide a method by which the intelligibility of audio signals is not compromised during electrooptical processing.

Still another object is to provide a method by which signals are transformed at a greater or lesser rate to enhance their intelligibility.

Yet another object is to provide a method by which a signal transformation is accomplished by an electrooptical processor quickly and relatively inexpensively.

Another object is to provide a method of frequency translation using an electrooptical processor having a reduced complexity.

A further object is to provide a method of frequency translation having no mechanically moving parts.

Yet another object is to provide an electrooptical processor which because of its simplicity is inherently highly reliable.

Still another object is to provide a method of signal translation which eliminates the need for an optical imaging system.

A further object of the invention is to provide a method for signal processing which lends itself particularly to the compression or expansion of underwater-diver-originating signals to permit greater intelligibility.

These and other features, objects, and advantages of the present invention will be better appreciated from an understanding of the operative principles of a preferred embodiment as described hereinafter and as illustrated in the accompanying drawings.

BRIEF DESCRIPTION OF THE DRAWINGS

FIG. 1 is a schematical representation of a typical electrooptical processor modifiable for the novel method of this invention.

FIG. 2 depicts a device for assuring a relatively uniform light distribution in a compact, rugged package.

FIG. 3 exemplifies a simple method employing a shift-and-add mode of operation of a line-array CCD.

FIG. 4 is a representation of the movement of charge packets in the line-array CCD of FIG. 3.

FIG. 5 schematically represents a line-array CCD modulation technique employing a moving mask.

FIG. 6 shows the timing relationships between the input samples and output samples in the FIG. 5 embodiment.

FIG. 7 depicts the charge packet shifting in the line-array CCD of the FIG. 5 embodiment.

FIG. 19 shows the waveform obtained by sampling only every 7th sample of the CCD's output waveform.

FIG. 20 shows different output waveforms created by sampling the CCD's output at different rates.

DESCRIPTION OF THE PREFERRED EMBODIMENTS

Figure 8:
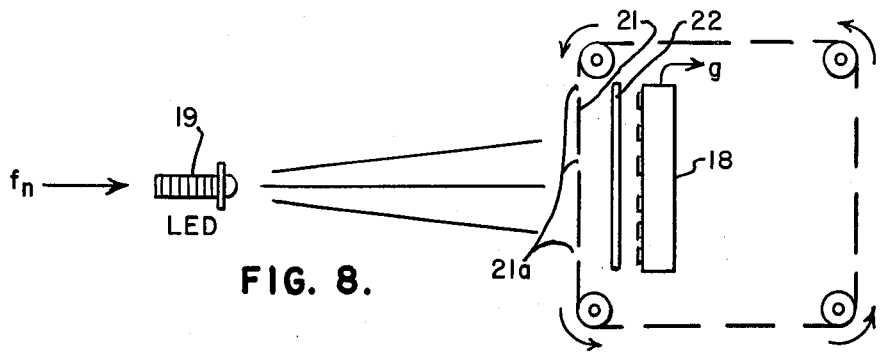
FIG. 8 is a depiction of another variation of the line-array CCD implementation.

Referring now to the drawings and in particular to FIG. 1 of the drawings, the evolution and development of this inventive concept will be explored in detail so that the salient features of this invention can be more readily understood and patentably distinguish particularly in view of the cited art identified above.

A typical, electrooptical processor 10 is depicted in FIG. 1. A modulated light source, typically an LED 11, radiates incoherent light through a photographic mask 12 and onto an area-array CCD 13. The optical output of the LED is modulated in such a way that the output irradiance is linearly proportional to the input electronic signals representative of acoustic energy, for example, human speech and projected onto the photographic mask. This modulation may be continuous or pulsed depending on the specific CCD structure. Clocking synchronization and sampling circuitry is included to assure reliable system operation. The exact circuitries are not shown to avoid belaboring the obvious and since the clocking waveforms differ from one CCD model or manufacturer to another. The configuration of apertures in the mask will be elaborated on below, but suffice it to say at this point that the manner of forming the apertures in the mask is consistent with practices widespread in the photographic microminiaturization and related arts. The area-array CCD is a multi-element device, which for the purposes of this discussion, will restrict itself to being a six by six cell element CCD with an interconnected horizontal shift register 14 coupled to the CCD by a number of taps 15. In practice, CCDs having hundred or thousands of cells are envisioned.

The mask has a number of masking or aperture areas corresponding in number and location to the cells in the CCD. Optionally, the LED-illuminated mask can be imaged onto the CCD via lenses or fiber optic techniques thereby allowing ready interchangeability of masks although a somewhat simpler and more compact device results if the mask is fabricated directly on the CCD surface as depicted in FIG. 1.

Lenses and other light distribution schemes can be employed within the state-of-the-art to equally illuminate the mask. A typical folded light-distribution arrangement is shown in FIG. 2 in which a cover 16 is provided with a diffuse reflecting surface 16*a* that uniformly distributes radiated optical energy on the mask and CCD.

The signal processor outlined in the paragraphs is well known in the state-of-the-art. The first four references set forth above disclose electrooptic processors which are fabricated very much in accordance with the processor portrayed in FIG. 1. This type of a processor has been used for multichannel cross correlation, Fourier transforms, coding, read-only memories, etc.

Thus, although the structure by which the method of the instant invention is accomplished has been within the state-of-the-art for some time, the method of using such an electrooptical processor for raising or lowering the pitch of an input signal by some predetermined factor while maintaining the gross temporal relationships of the input signal has not been practiced. Thus, an input signal representative of speech could be shifted in pitch to make a bass singer sound like a tenor without speeding up the delivery rate of the words, thereby avoiding sounding like a "Donald Duck-sounding" audio reproduction. This capability will be particularly welcomed in the diving community where the unintelligibility of diver communications has long been a problem. The claimed electrooptic method of raising or lowering the pitch is a multiplication of all frequencies by a constant multiplicative factor. This is not a frequency translation by the mere adding or subtracting of a quantity since this would result in the loss of all harmonic relationships and, hence, degrade intelligibility.

Compressing and expanding the frequency of an input signal has been done by various devices in the past as witnessed by the disclosures of the last two references noted above. The Gabor device relied on a mechanical-optical coaction to compress or expand the frequency of an input signal. Such a mechanical-optical device frequency response and long term reliability are questionable. In the last reference, electronic RAM is relied upon to effect a pitch changing of chunks of an input signal. This necessarily unduly complicates the device by reason of the inclusion of the associated A to D converter and a D to A converter along with their driving circuitries.

The essence of the method of this invention resides in the use of an electrooptical processor, which, because of its simplicity has high long-term reliability. The following specification traces the progress of this inventive concept by setting forth a series of relatively simplified examples as they evolve to a more capable form.

Looking to FIG. 3, a simple form of an electrooptical processor first will be examined. A one-dimensional mask 17 allows a limited illumination of a six element line-array CCD 18 by an LED 19 shining through a single aperture 17*a* in the mask. Operation of this line-array CCD is generally referred to as being in the "shift and add" mode or the "time delay and integration" mode of operation. That is, the charge packet created by the photons striking a particular photocell is shifted vertically by one charge-transfer cell at a time upon receiving an appropriate clocking pulse; thereupon, a charge packet created by photons striking the next higher photocell is added to the shifted charge packet. The process occurs for all photocells in the line-array and charge is transferred between all cells simultaneously. The size of the charge packet emerging from the top of the line-array CCD is proportional to the sum of all the light intensity values striking the appropriate photocells as the charge packet travels vertically upward.

An interesting phenomenon occurs in the processor depicted in FIG. 3 having a mask 17 provided with a single transparent aperture 17*a*. The one dimensional mask is completely opaque except for the single transparent opening spaced at the equivalent of A photocell spacings (in this case five) from the top of the six element CCD. The output g from the top of the CCD is proportional to the pulsed signal $f_n$ modulating the LED but delayed in time by an amount equal to A times the vertical shift period T of the CCD. It is quite apparent that the aperture in the mask may be located anywhere along the line-array CCD to vary the delay of the charge packets a preestablished time.

Looking to FIG. 4, this phenomenon is more clearly shown. A six-element line-array CCD 18 has its fifth element aligned with the transparent window 17*a* of mask 17. In FIG. 4, the sample value of the input signal modulating the intensity of the LED starts at an arbitrary starting time "1". The sequence depicted in FIG. 4 from left to right and top to bottom from clocking times "1" through "12" show the location of the charge packets which are proportional to the irradiance on the photocells as they are clocked vertically up line-array CCD 18 at the same rate as the input samples modulate LED 19. In this figure and subsequent ones, only a six-element mask and line-array CCD are depicted for convenience although CCDs having hundreds or thousands of elements are commercially available.

Since the aperture in the mask is placed over the fifth photocell from the top of the CCD, the output is a replica of the input but delayed by five vertical shift periods. In this and subsequent examples, the details of how the incident photons are converted to charge packets and how these are shifted along the register will not be elaborated on to avoid unnecessary detail. These details vary from manufacturer to manufacturer and are well known to those knowledgeable in CCD technology. Thus, it can be seen that an LED and line-array CCD synchronously pulsed and having an interposed mask can readily effect the operation of simple variable time-delay.

A much more sophisticated operation is within the capabilities of the photo processor shown in FIG. 5. This processor is identical to that of FIG. 3 except that it has a moving mask 20 provided with a single transparent aperture 20*a*. The mask is allowed to continuously move in the vertical direction as the input signal $f_n$ modulates LED 19. (As an illustration, the mask is depicted in FIG. 5 as an endless loop of film traveling along pulleys; however, any means of translating a mask (or an image thereof) across the surface of the CCD will suffice). Assume for the moment that the line-array CCD has an infinite number of cells so that end effects can be ignored. The CCD output g will be a speeded up, slowed down, or even a backwards version of the input $f_n$ depending on whether the mask is traveling upward or downward and on its velocity relative to the CCD vertical shift rate. For example, if the signal input rate $f_n$ is one sample every T seconds and the line-array CCD vertical shift rate is equal to the signal input rate (one shift upward every T seconds) and the mask velocity equals one photocell downward every T seconds, then as noted in FIG. 6, every other output sample from CCD 18 is an input sample. In other words, the output shown on the right hand side of FIG. 6 is a replica of the input shown on the left-hand side of FIG. 6 except that the sampling rate appears to be slowed down by a factor of two. Consequently, all frequencies have been halved. FIG. 7 shows the relative positions of the aperture 20*a* of the mask 20 and the location of the charge packets in line-array CCD 18 for this case.

Generally speaking, if aperture 20*a* of mask 20 moves downward with respect to line-array CCD 18, the CCD's output is a slowed down version of the input. If the mask is stationary, then the phenomenon associated with the processor of FIGS. 3 and 4 is recreated and the output of the CCD has the same rate as the input but is delayed by a certain period. If aperture 20*a* of mask 20 is moved upwardly with respect to the CCD at a rate slower than the CCD vertical shift rate, the output is a speeded up replica of the input. An upward mask velocity equal to the CCD shift rate yields an impulse like output and a faster upward mask speed yields backward versions of the input.

On of the limitations of the electrooptical processor depicted in FIG. 5 is quite evident when the finite length of line-array CCD 18 is taken into account. When transparent aperture 20*a* reaches the end of the line of photocells, that is, after six shifts of the charge packets (see FIG. 7), the cycle cannot be started over again with the next section of input samples because the CCD shift register still contains data which needs to be shifted out without being contaminated by new data. For example, noting FIG. 7, if aperture 20*a* were to start at the top photocell after six shifts, as the input sample 7 was introduced into the LED, then sample 7 would be added to sample 4 in the top shift register element. Thus, because of the finite length of the CCD, a further modification is necessary to create a useful device.

While the photo processor of FIG. 5 gave an output which was a replica of the input, except for being lower or higher in frequency and slower or faster in time, the same operation could be easily achieved by using a conventional tape recorder and varying the recording and playback speeds. However, higher speed playbacks would result in a "Donald Duck-sounding" distortion which would render the playback information at least partially unintelligible. A more desirable operation would be to provide a replica of the input which is higher or lower in frequency but within the original signals' time relationship at least in a gross sense. This desirable result can be accomplished by the system of FIG. 8.

The system set forth in FIG. 8 has a line-array CCD 18 receiving pulsed optical signals from LED 19, the pulsed optical signals occurring at substantially the same rate as the vertical shift rate of the line-array CCD. A moving mask 21 having several transparent apertures, 21*a* yields an output which is much the same as that produced by the embodiment of FIG. 5 but with the additional effects produced by a stationary Gaussian mask 22 interposed between the moving mask and the CCD. The Gaussian weighting function mask is superimposed on the CCD surface, or alternatively, is imaged onto it using lenses or fiber optics. The mask has an intensity transmittance whose spatial variation from top to bottom is a Gaussian curve, that is, the photocells near the center of the CCD receive more light then those near the top and bottom extremes.

As an alternative, mask 22 could have had a weighting function that defines a triangular waveform or any of many other "window functions". An article by Fred J. Harris entitled "On the Use of Windows for Harmonic Analysis with the Discrete Fourier Transform" appears in Vol. 66 of the Proceeding of the IEEE 1 January '78. It is a concise review and catalog of data windows along with their significant performance parameters. A Gaussian curve was chosen because it has been found to yield a minimum uncertainty in time and frequency. The CCD output is the sum of several Gaussian weighted versions of the speeded up or slowed replicas of sections of the input signals, depending on the direction of travel and velocity of movement of the single aperture 21*a* of mask 21.

Figure 9:
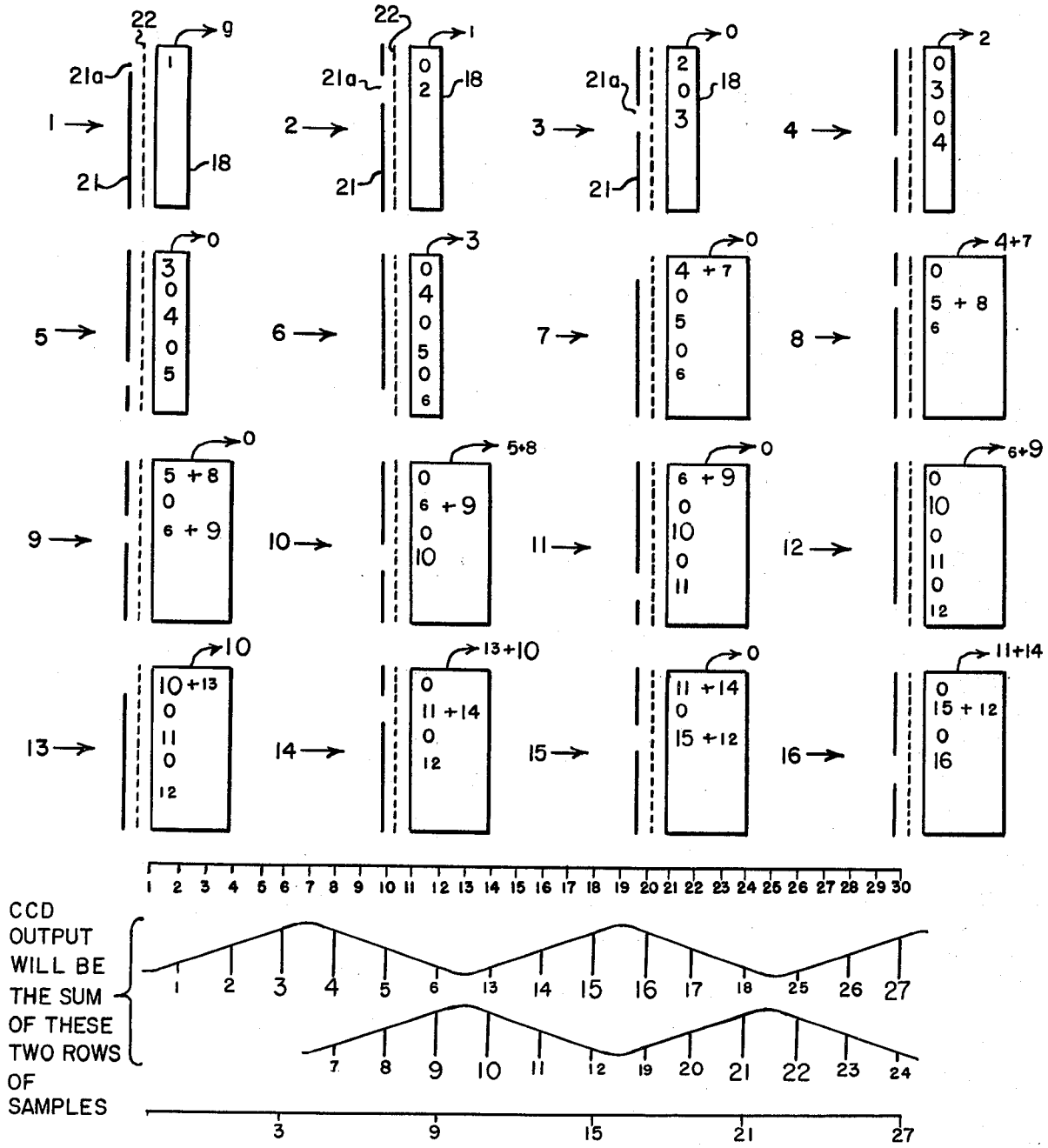
FIG. 9 depicts charge packet transfer and waveforms generated in the FIG. 8 variation.

Looking to FIG. 9, the step-by-step charge packet locations are depicted and at once it is noted that there is a striking similarity to the information shown in FIG. 7 but for the inclusion of the fixed Gaussian weighting mask 22.

In FIG. 9 and the subsequent figures, the relative physical size of the numbers, denoting the charge packets representing various input samples, is used to denote the weight assigned to that sample by the stationary Gaussian mask 22. The addition of the stationary Gaussian mask overcomes the finite CCD length problem brought out in the disclosure of the embodiment of FIG. 7. In this later embodiment, the sampling process is cyclic. The apertures 21*a* are spaced so that as one reaches the bottom or top of the CCD (depending on which way the movable mask 21 is traveling) another aperture appears at the CCD's opposite end.

FIG. 9 shows that two sets of charge packets, representing two different sections of the input samples, are added together. However, the Gaussian weighting mask 22 ensures that as one section of the samples gets a large weighting, the other section added to it gets a low weighting. Looking to the bottom of the figure, the input samples to the LED are depicted in a sequence of 1 through 30 impulses. Synchronously with the pulsing of the LED, the line-array CCD is vertically shifted upwardly and, for this example, the movable mask 21 moves in a downward direction at a speed corresponding to the vertical shift rate of the CCD. The two added sets of sections of samples alternately have a large weighting. The time of the samples at weighting peaks of both sets of samples is the same as that of the incoming signals so that the gross or coarse temporal characteristics have been retained even though all the frequencies in the sampled signal eminating from the LED have been halved.

By noting the overlapping waveforms at the bottom of FIG. 9, it is apparent that the Gaussian weight mask helps reduce the "glitch" created by the transition between successive sections. The overlapping waveforms having alternate weighting peaks between the two sections also smooth the composite output signal and diminish flutter in the reproduced signal.

Figure 10:
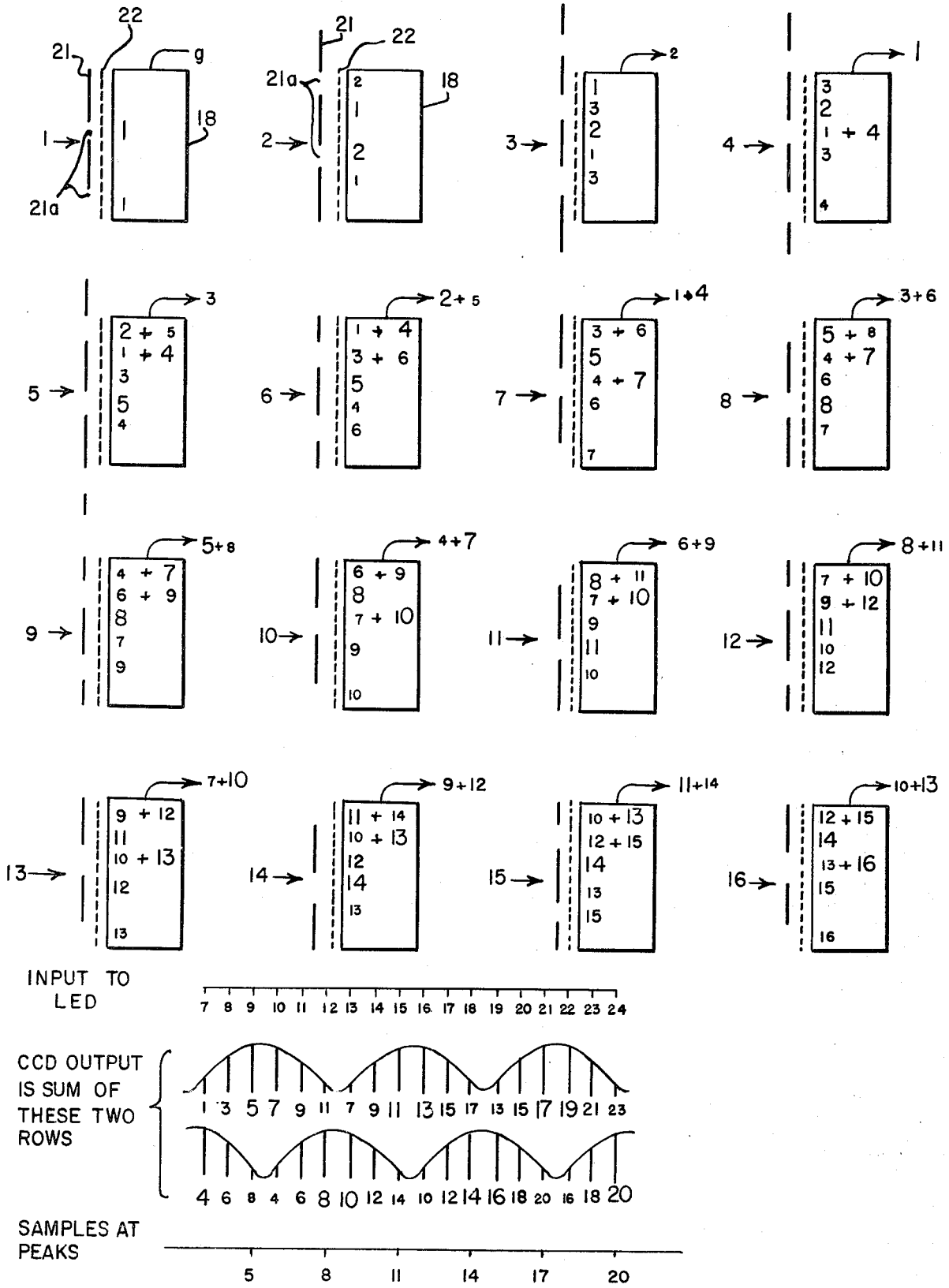
FIG. 10 shows charge packet transfer and waveform distribution using a two-aperture moving mask.

FIG. 10 depicts two modifications of the embodiment of FIG. 8: one is that there are two apertures 21*a* per six photocells in the CCD instead of only one, and the other is that the movable mask 21 is moved upwardly at a velocity twice the pulse rate of the LED and the vertical shifting rate of the charge packets in the CCD. Consequently, as shown in FIG. 10, all frequencies are doubled and yet the relative temporal relationship between the samples at the weight peaks remains the same as that of the input signals to the LED. Thus, the two modifications do, in fact, provide for a shifting of the frequencies while maintaining the gross temporal relationship. However, a limitation resides in the inclusion of a movable mask 21 to limit the processors' reliability and compactness.

The embodiment schematically set forth in FIG. 1 overcomes most of the shortcomings of the previously discussed designs by defining an electrooptical processor 10 employing an area-array CCD 13. A fixed mask 12 is an M by N element mask superimposed or imaged onto an M by N photocell area-array CCD 13. For the purposes of explanation, both M and N are equal to six although it is within the purview of this inventive concept to embrace masks and CCDs having many hundreds or thousands of elements. A horizontal shift register 14 is coupled to the output to the area-array CCD by M taps. In order to avoid undesired merging of the charge packets in the CCD, the shift rate of the horizontal shift register is M times faster than the shift rate of the vertical registers to ensure that the horizontal register is empty before the top row of the M by N matrix of charge packets is shifted into it. Thus, the CCD output sample rate $g_m$ is M times faster than the vertical shift rate and hence is M times faster than the sample rate into the LED 11.

The evolution of the area-array CCD is an electrooptical processor will follow in much the same manner as the line-array CCD processor was developed above. The following will trace the maturation of an area-array CCD processor from a relatively uncomplicated delay device to a sophisticated processor that changes the pitch of a signal without appreciably changing the gross temporal characteristic.

Figure 11:
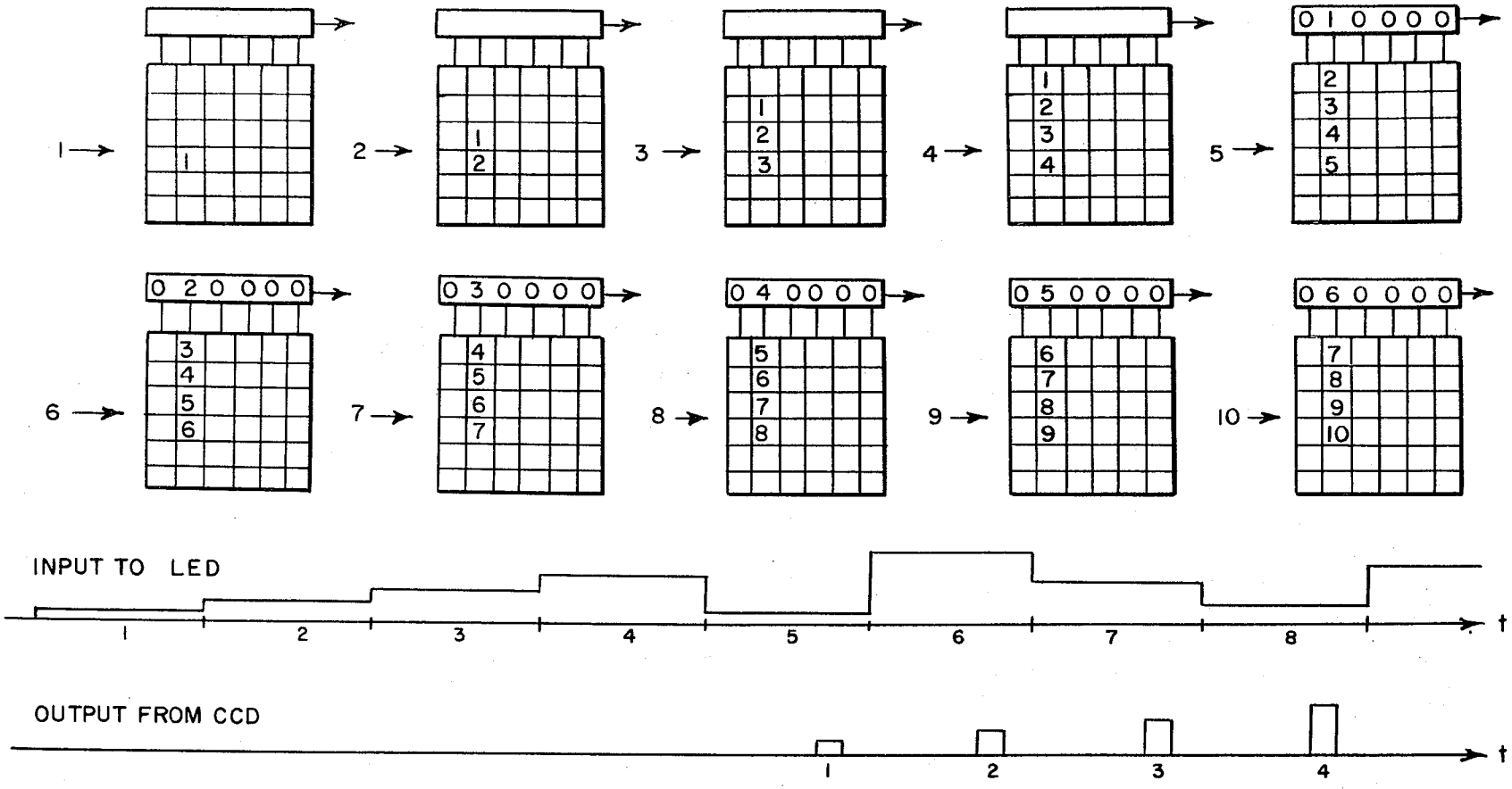
FIG. 11 depicts the charge packet transfer and waveforms generated in the area-array CCD of FIG. 1 with a single-aperture mask.

In a first electrooptical processor having an area-array CCD configuration, the mask is opaque except for a transparent aperture at the intersection of the $p^{th}$ column and $q^{th}$ row. FIG. 11 shows the step-by-step locations of the charge packets within an area-array CCD 13 for the case of M=N=6, P=5 and Q=3. It can be seen that the CCD output is a sampled version of the input with a duty cycle of 1/M and delay of (N+1-q) T seconds (due to the number of vertical shifts between the $q^{th}$ row and the horizontal shift register, where the vertical shift period is T) plus $$\frac{(p)}{M}\ \frac{(T)}{M}$$

seconds (due to the number of shifts between the $p^{th}$ column and the horizontal shift register output where T/M is the horizontal shift period).

Figure 12:
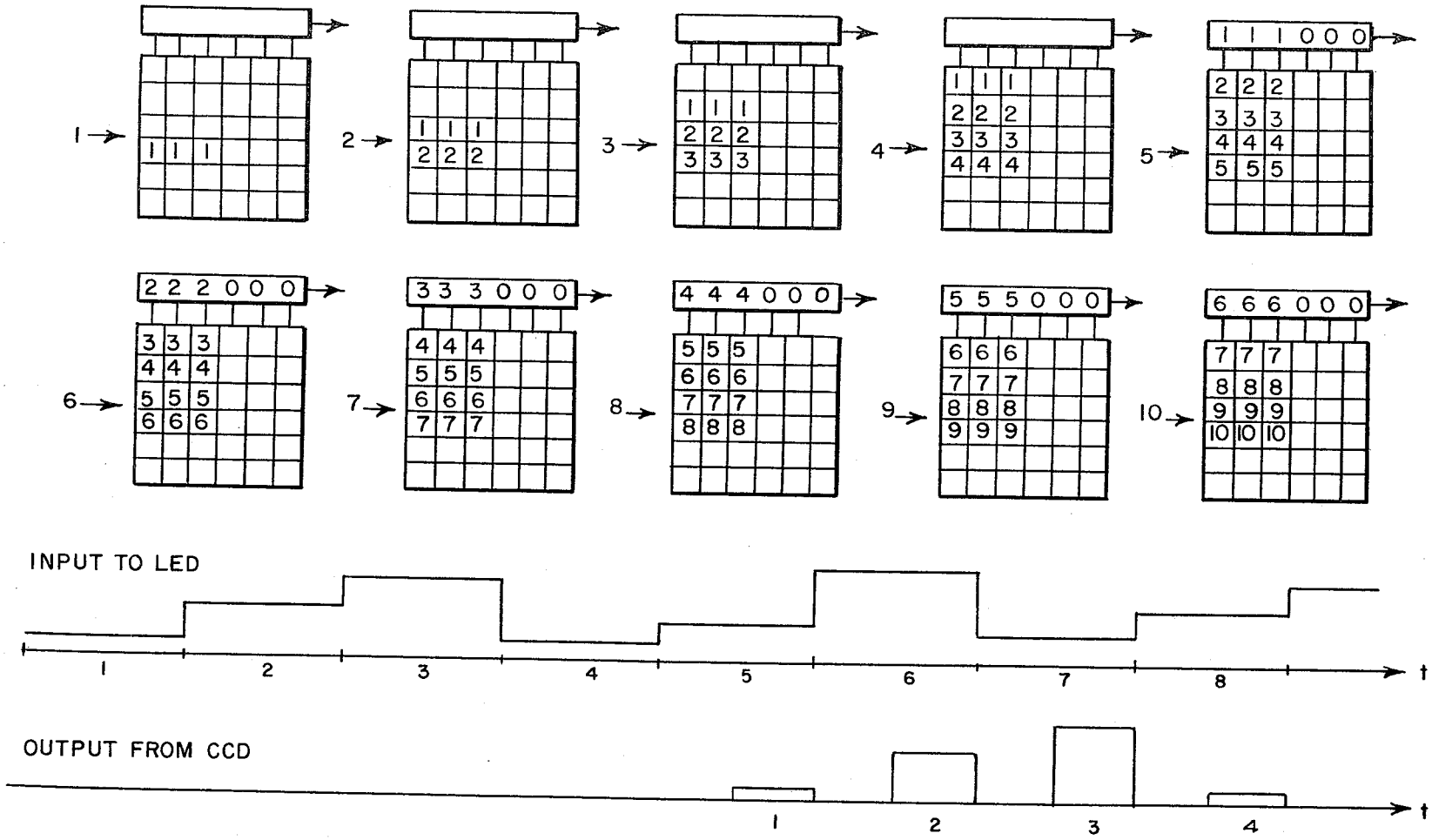
FIG. 12 depicts the charge packet transfer and waveforms generated in the area-array CCD of FIG. 1 with a three-aperture mask.

FIG. 12 shows the identical case except that apertures appear at the intersection of the $(p\text{-}1)^{th}$, $p^{th}$, and $(p+1)^{th}$ columns, and the $q^{th}$ row. This changes the duty cycle to 3/M. Any of M different duty cycles can be selected in a like manner.

The electrooptical processor whose characteristics are set forth in FIGS. 11 and 12 acts like a bank of M parallel delay lines (if each column of the mask contains only one aperture). But there is no constraint on having every column set at the same delay since the apertures can be staggered in any desired manner in adjacent columns. Consider the case in FIG. 13 where every column is set at a different delay. The mask 23 is provided with a diagonal line of transparent apertures 23*a* such that m=n.

Figures 13, 14:
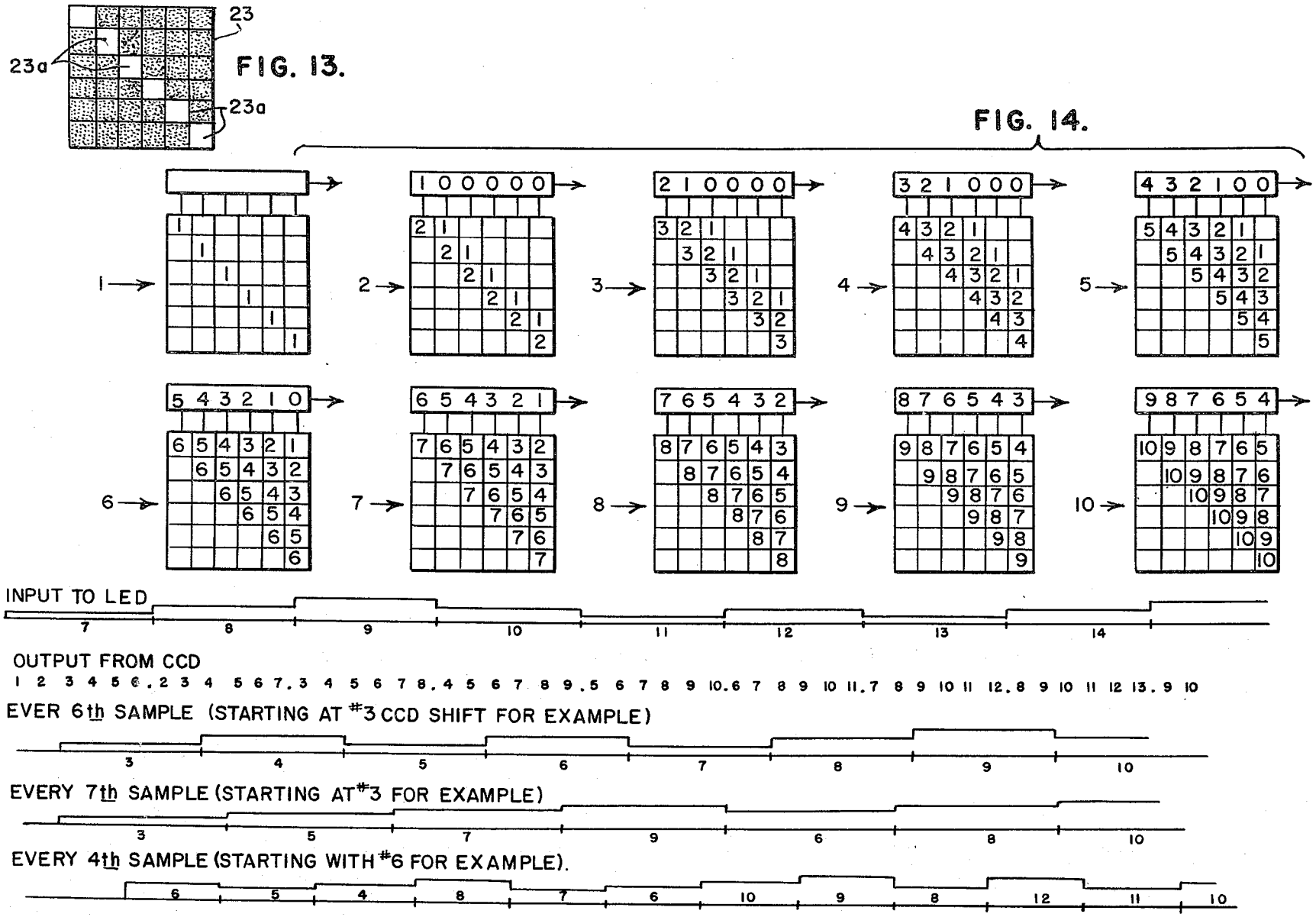
FIG. 13 is a representation of a diagonally apertured mask.
FIG. 14 shows the charge packet transfer and waveforms generated in the area-array CCD of FIG. 1 with the diagonally apertured mask of FIG. 13.

FIG. 14 shows the step-by-step location of the various charge packets. As each new input sample modulates the LED the previous M samples are read out of a horizontal shift register. For example, in FIG. 14 as sample 8 modulates the LED, samples 2, 3, 4, 5, 6 and 7 emerge from the CCD. If the output from the CCD is sampled (by, for example, a sample-and-hold circuit at the output of the horizontal shift register) at every 6th sample, the resulting data stream will be simply a replica of the input but delayed by an amount depending on the point in the CCD output at which the sampling starts. The case of starting the sampling at output sample number 3 is depicted in the lower portion of FIG. 14.

When this CCD output is sampled at a slower rate, a sequence of sections of the input signal is obtained where each section is a compressed replica of that section of the input. The case of selecting every 7th sample (a slower sampling rate) is shown at the bottom of FIG. 14 as the selection starts at the $3^{rd}$ CCD shift.

The sample selection process at the CCD output does not need to have an integer value rate. If the CCD output is sampled at a rate of one sample every 5.5×T/M seconds, where T/M is the horizontal clocking period, then the output of the CCD would be a sequence of sections of the LED-input slowed down by a factor of two (that is, all the frequencies are multiplied by ½ in each section). A sampling rate between selecting every 5th and every 6th sample of the CCD output yields an expanded replica of the input in each section of the output.

When the CCD output is sampled at every 5th sample of the CCD output, each section has a constant value. When the CCD output is sampled at a rate faster than selecting every $5^{th}$ sample the output is a sequence of sections of backward versions of the input. For example, the bottom example in FIG. 14 depicts the case of selecting every 4th sample starting with sample number 6.

Note that in each of these examples, the timing and frequency relationship within each section have been changed by the processor, but the section-to-section timing (which contains the coarse or gross temporal information) is unchanged.

The several different modes of operation mentioned above can be concisely expressed by several formulas where P is the selected sampling period at which we sample the output waveform of the CCD, the CCD has M columns and the CCD horizontal shift period is H. Note that H=T/M.

When $$P > MH$$

then each segment is compressed and the pitch is increased within the original gross temporal relationship.

When $$P = MH$$

the output waveform is the same as the input. However, the output is delayed by a period corresponding to some integer multiple of the vertical shift period of the CCD.

When $$(M\text{-}1)H < P < MH$$

each segment is expanded with a consequent decrease in the pitch.

As the condition $$P = (M\text{-}1)H$$

occurs, each segment appears as a reoccurring d.c. signal until the $M^{th}$ sample whereupon a "glitch" will signal another d.c. signal of duration M.

Lastly, when $$P < (M\text{-}1)H$$

each segment is backwards.

The main drawback of having a diagonal mask 23 with the equally sized apertures 23*a* as shown in FIG. 13 is that a sharp jump occurs between the sections of the final output. If this were an audio signal, for example, this would produce a highly objectionable noise commonly referred to in the art as "glitch".

Figure 15:
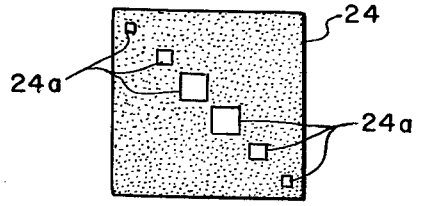
FIG. 15 depicts a diagonally apertured mask with a Gaussian weighting.
Figure 15A:
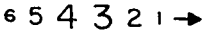
FIG. 15*a* represents the relative charge packet amplitude produced by the diagonal Gaussian mask.

The "glitch" can be overcome by applying a stationary smoothing mask which could be a Gaussian, triangular, etc., weighted mask and which functions much the same in principle as does the mask referred to in the embodiments of FIG. 8 supra. One option is to superimpose on top of the diagonal-line mask a Gaussian weighting mask (i.e., a transparency with a uniform transmittance horizontally and a Gaussian transmittance profile vertically). A simpler method is to utilize the equal-aperture diagonal-line mask but cause the optical illumination to be nonuniform, (i.e., to provide an irradiance distribution on the mask/CCD plane which is uniform horizontally and Gaussian vertically). A preferred method to achieve the same result is to use a uniform illumination and to vary the area of the transparent apertures comprising the diagonal line mask in a Gaussian fashion from top to bottom as depicted in FIG. 15. For this case, the distribution of the CCD output is the same as that shown in FIG. 14 except that the magnitude of the charge packets is a function of the Gaussian weighting function. Thus, as sample 7 modulates the LED it produces the same charge packets at the output of the horizontal register as shown for sample 7 in FIG. 14 but with a weighting function shown in FIG. 15*a*, where again the size of the sample number denotes the weighting applied by the Gaussian mask.

Figure 16:
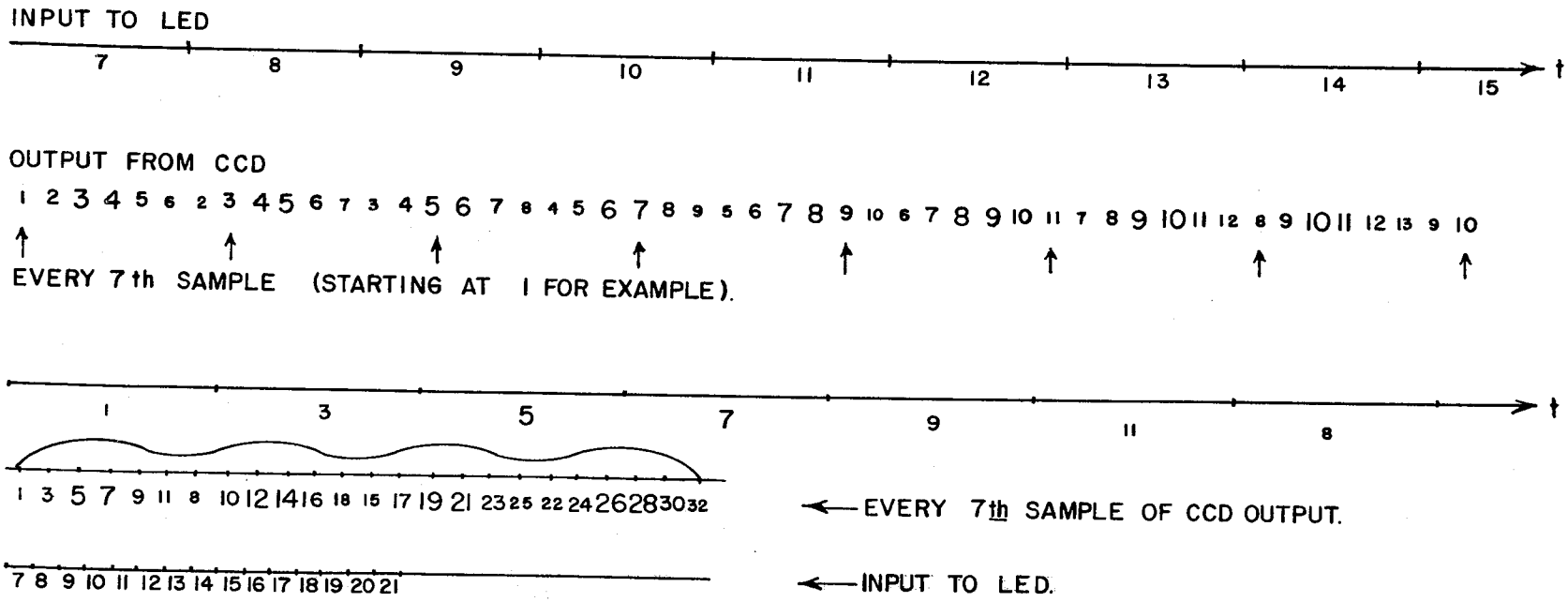
FIG. 16 represents the output waveforms produced by the CCD of FIG. 1 employing the diagonal Gaussian mask.

FIG. 16 shows a representative sequence of the CCD outputs produced showing the sequence produced by selecting every $7^{th}$ sample. The weighting mask has reduced the sharp jump or "glitch" between adjacent segments but has introduced an undesired amplitude modulation which might make an audio signal, for example, sound trilled or fluttered.

The fluttering can be overcome by using more than one diagonal Gaussian-weighted line in the mask. The net effect of more than one diagonal line of Gaussian-weighted apertures is that more than one sequence of numbers are added together in the CCD just as the use of more than one aperture in the moving mask shown in FIG. 8 produced a sum in the output.

Figure 17:
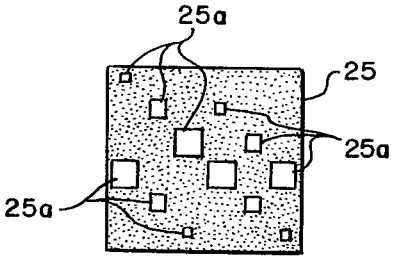
FIG. 17 shows a double diagonally apertured Gaussian weighted mask.
Figure 18:
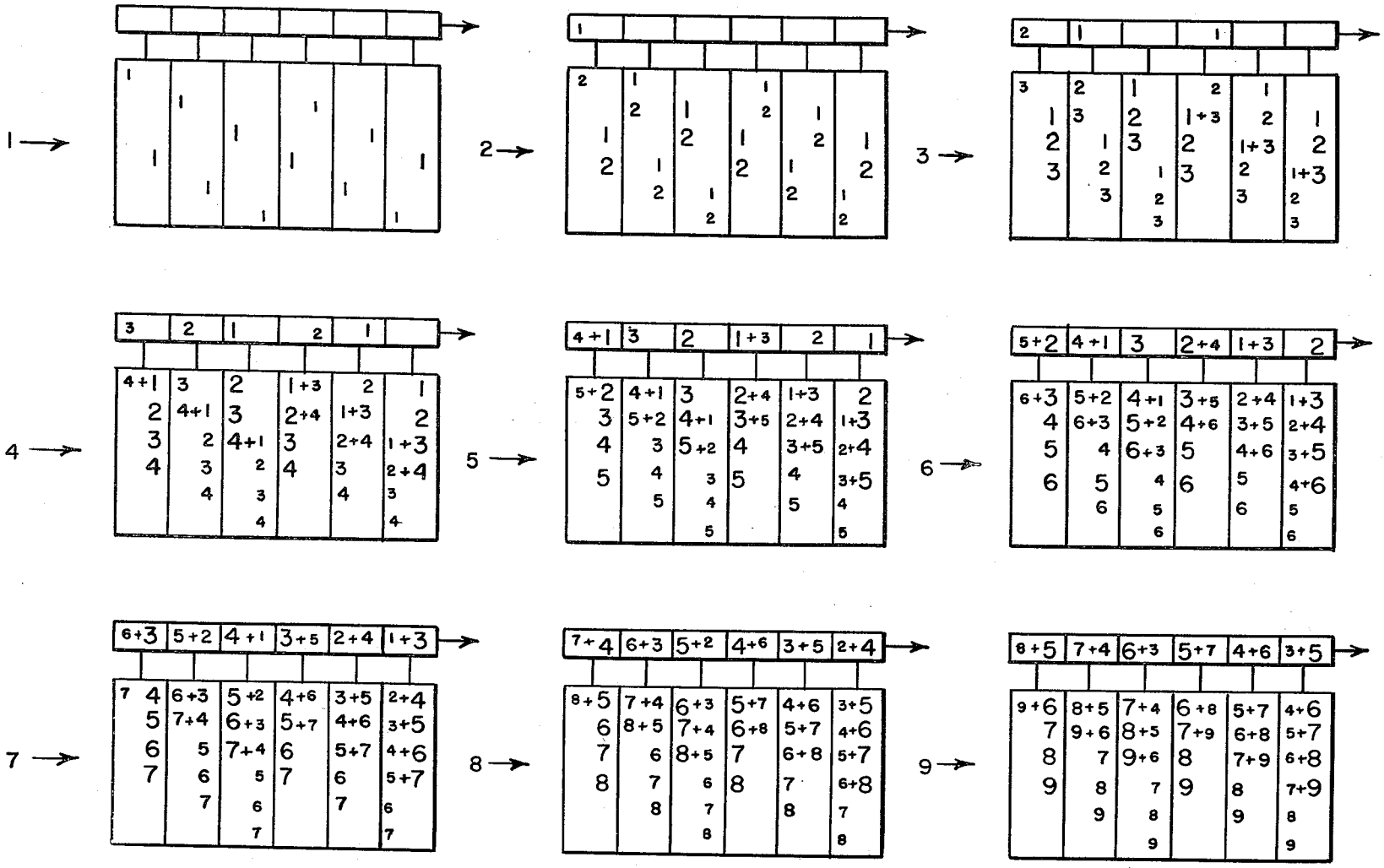
FIG. 18 depicts the charge packet transfer within the area-array CCD of FIG. 1 employing the double diagonally apertured Gaussian weighted mask of FIG. 17.

A typical multi-diagonal Gaussian weighting mask 25 having a number of Gaussian apertures 25*a* is shown in FIG. 17, and FIG. 18 depicts the location of the charge packets and their relative magnitudes. A steady-state condition is created and exists after the $6^{th}$ input sample modulates the LED. The CCD output after this point is shown in FIG. 19 and selecting every $7^{th}$ sample of this output yields the sequence of Gaussian-weighted sections of speeded-up versions of the input as depicted in this FIG. The sum of these sections yields an output with a nearly constant amplitude weighting (the amplitude weighting would be exactly constant if a triangular weighting function had been selected instead of the Gaussian one.) As one section leads in, the preceding section fades out, and the gross temporal relationship between the sections is substantially the same as that in the original input signal.

The same criteria and explanation discussed regarding the waveforms at the bottom of FIG. 14 in regard to the effects of various sampling rates applies also to the double diagonal Gaussian mask 25. That is, sampling at a slower rate than selecting every $6^{th}$ sample produces sections of speeded-up versions of the input. For example, in FIG. 20, selecting every $8^{th}$ sample yields overlapping sections in which the frequencies have all been multiplied by 3. Selecting every $6^{th}$ output sample provides an output rate the same as the input rate. A sampling rate between every $5^{th}$ and $6^{th}$ sample provides a slowed down version of the input. For example, FIG. 20 shows that selecting every $5.5^{th}$ sample divides all frequencies in a given section by 2. Sampling faster than every $5^{th}$ sample yields backyard versions of the input. For example, taking every $4^{th}$ value is shown in FIG. 20.

If the CCD and mask each have 100 by 100 elements and the input-signal sample rate is 10,000 samples per second, then the vertical shifting period would be 0.1 milliseconds and the section length would be $100 \times 0.1$ milliseconds, that is, 10 milliseconds. Such a system would be well suited for voice processing.

Figure 21:
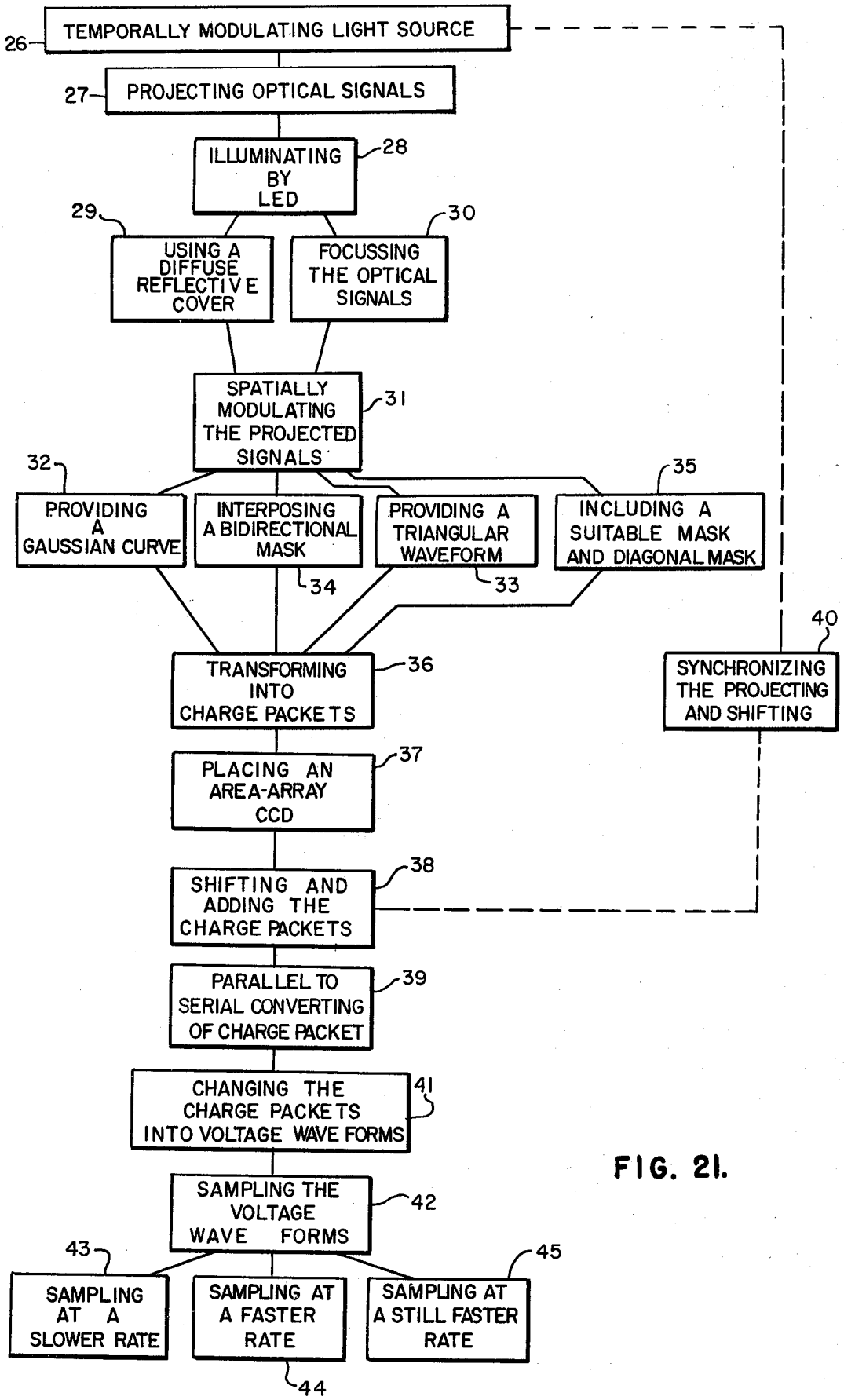
FIG. 21 shows the method of this invention.

Turning now to FIG. 21 of the drawings, the method by which the electrooptical processor described above is set forth in block diagram form. First there is a temporally modulating 26 of a light source with input signals. The modulating can consist of modulating the output irradiance linearly proportional to a desired input signal. Next there is a projecting 27 of optical signals by the illuminating 28 by an LED or equivalent source at a clock rate and a using 29 of a diffuse reflective cover or a focusing 30 of the optical signals and a subsequent spatial modulating 31 of the projected signals. The modulating of the projected signals may be performed in a variety of ways. One of the preferable ways is the providing 32 of apertures in a fixed-apertured smoothing mask that defines at least one Gaussian curve. Optionally, the providing 33 is in a series of apertures defining a triangular or other suitable waveform. Another option is the having the modulating an interposing 34 of a bidirectionally moving mask when mechanical devices are not overly objectionable. Still another option in the step of spatial modulating would be the including 35 of a Gaussian or triangular or other suitable mask and a diagonal mask.

A transforming 36 of the optical signals into charge packets preferably includes the placing 37 of an area-array CCD to receive the projected signals and a subsequent shifting and adding 38 of the transformed charge packets. The case of an area-array CCD calls for the converting 39 of the charge packets from a parallel to serial form in a horizontal shift register on the output side of the CCD.

A synchronizing 40 of the steps of projecting 27 the optical signals and the shifting 38 of the charge packets assures more reliable and responsive operation of the system of this method. Next a changing 41 of the charge packet into voltage waveforms and finally there is a sampling 42 of the charge packets at a lower, rate of sampling 43 to effect a compression or speeding up of the frequency of the signals which in their own temporal relationship, a faster rate sampling 44 to effect an expanding or slowing down of the frequency of the signals within their original temporal relationship or lastly a still faster sampling 45 to effect a repetitive reversal of sequential portions of the signals within their original temporal relationship. Variations of the sampling rates can be made to perform the functions of the formulas set forth above.

Obviously, many other modifications and variations of the present invention are possible in the light of the above teachings. It is therefore to be understood that within the scope of the appended claims the invention may be practiced otherwise than as specifically described.

What is claimed is:

1. A method of compressing or expanding the frequency of signals and keeping the signals' original gross temporal relationship by an electrooptical processor comprising:

temporally modulating a light source with desired input waveforms;

projecting temporally modulated optical signals;

spatially modulating the magnitude of the projected optical signals by an aperture-mask;

transforming the modulated projected signals to a number of charge packets in a charge coupled device;

vertically shifting and algebraically adding the transformed charge packets in the charge coupled device; and sampling voltage waveforms which are representative of the shifted and added transformed charge packets at a rate different than the signals were projected to effect a change of pitch of the signals within the signals' original gross temporal relationship.

2. A method according to claim 1 in which the step of temporally modulating the light source consists of modulating the output irradiance linearly proportional to a desired input waveform.

3. A method according to claim 1 in which the step of projecting includes the illuminating by a suitable source such as an LED at a clock rate and the directing of the optical signals to the apertured mask.

4. A method according to claim 3 in which the step of projecting includes using a diffuse reflecting cover to provide a uniform light distribution for the step of modulating.

5. A method according to claim 3 in which the step of projecting includes focusing the optical signals with a lens to provide a spatially uniform light distribution.

6. A method according to claim 1 in which the step of spatial modulating includes the providing of apertures in a fixed apertured mask that define at least one Gaussian curve.

7. A method according to claim 1 in which the step of spatial modulating includes the providing of apertures in a fixed apertured mask that define at least one triangular waveform.

8. A method according to claim 1 in which the step of transforming includes the placing of an area-array CCD to receive the modulated projected signals.

9. A method according to claim 8 further including: synchronizing the step of projecting the optical signals and the step of shifting and adding of the charge packets at a synchronizing rate.

10. A method according to claim 8 in which the step of sampling of the CCD output voltage waveforms is at a rate slower than the synchronizing rate to effect a compression or speeding up of the frequency of the signals within their original gross temporal relationship.

11. A method according to claim 8 in which the step of sampling of the voltage waveforms is at a rate faster than the synchronizing rate to effect an expanding or slowing down of the frequency of the signals within their original gross temporal relationship.

12. A method according to claim 8 in which the step of sampling of the voltage waveforms is at a rate even faster than the rate of claim 10 to effect a repetitive reversal of sequential portions of the signals within their original temporal relationship.

13. A method according to claim 1 in which the step of modulating includes the use of a line-array CCD and the interposing of a bidirectionally movable apertured mask in the path of the optical signals to provide the option of compressing, maintaining or expanding the frequency of the optical signals within their original gross temporal relationship.

14. A method according to claim 6 in which the step of modulating includes the use of a line-array CCD and the interposing of a bidirectionally movable apertured mask in the path of the optical signals to provide the option of compressing, maintaining or expanding the frequency of the optical signals within their original gross temporal relationship.

15. A method according to claim 7 in which the step of modulating includes the use of a line-array CCD and the interposing of a bidirectionally movable apertured mask in the path of the optical signals to provide the option of compressing, maintaining or expanding the frequency of the optical signals within their original gross temporal relationship.

16. A method according to claim 8 in which the apertured mask is deposited on the surface of the area-array CCD to reduce the problems associated with the need to focus the optical signals onto the area-array CCD.

17. A method according to claim 8 in which the area-array CCD has N vertical cells and M horizontal cells and the CCD output sample rate is M times faster than the vertical shift rate which is equal to the set synchronizing rate.

18. A method according to claim 1 in which the step of spatial modulating includes providing apertures that define a smoothing function such as a Gaussian curve, triangular waveform and related waveforms, and a diagonal mask working in concert.

* * * * *